US008876247B2

(12) United States Patent
Kobayashi

(10) Patent No.: US 8,876,247 B2
(45) Date of Patent: Nov. 4, 2014

(54) LIQUID EJECTING HEAD MODULE AND LIQUID EJECTING APPARATUS

(71) Applicant: Seiko Epson Corporatio, Tokyo (JP)

(72) Inventor: Hiroyuki Kobayashi, Azumino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/746,565

(22) Filed: Jan. 22, 2013

(65) Prior Publication Data

US 2013/0187976 A1 Jul. 25, 2013

(30) Foreign Application Priority Data

Jan. 24, 2012 (JP) ..... 2012-012492

(51) Int. Cl.

| | |
|---|---|
| ***B41J 29/393*** | (2006.01) |
| ***B41J 29/38*** | (2006.01) |
| ***B41J 2/14*** | (2006.01) |
| ***B41J 2/155*** | (2006.01) |

(52) U.S. Cl.

CPC ..... *B41J 29/393* (2013.01); *B41J 2/14233* (2013.01); *B41J 2/155* (2013.01); *B41J 2002/14419* (2013.01); *B41J 2202/08* (2013.01); *B41J 2202/20* (2013.01)

USPC ..... 347/19; 347/17

(58) Field of Classification Search

CPC .... B41J 29/393; B41J 2/17546; B41J 2/0458; B41J 2/04581; B41J 2/14153; B41J 2/0451; B41J 2/2135; B41J 2/04563; B41J 2/04541; B41J 2/04528; B41J 2/04553

USPC ..... 347/17, 19

See application file for complete search history.

(56) References Cited

U.S. PATENT DOCUMENTS

2012/0176438 A1* 7/2012 Suzuki et al. ..... 347/17

FOREIGN PATENT DOCUMENTS

| | | | |
|---|---|---|---|
| JP | 06-031934 | | 2/1994 |
| JP | 06336024 | A * | 12/1994 |
| JP | 2009-056669 | | 3/2009 |
| JP | 2010-208068 | A | 9/2010 |
| JP | 2010-221577 | | 10/2010 |

* cited by examiner

*Primary Examiner* — Lisa M Solomon

(74) *Attorney, Agent, or Firm* — Harness, Dickey & Pierce, P.L.C.

(57) ABSTRACT

A liquid ejecting head module including: a head unit which has a plurality of heads having a nozzle plate on which a nozzle opening is provided; a carriage to which the liquid ejecting head unit is fixed; and a thermistor attached to the carriage, wherein the thermistor is biased to the cover head side which is in contact with the nozzle plate of a head, comes into contact with the nozzle plate and measures the temperature of the nozzle plate.

6 Claims, 9 Drawing Sheets

LIQUID EJECTING HEAD MODULE AND LIQUID EJECTING APPARATUS

BACKGROUND

1. Technical Field

The present invention relates to a liquid ejecting head module including a liquid ejecting head which ejects liquid from a nozzle opening, and a liquid ejecting apparatus, and in particular relates to an ink jet type recording head module and an ink jet type recording apparatus.

2. Related Art

As a liquid ejecting apparatus represented by an ink jet type recording apparatus such as an ink jet type printer or a plotter, there is an apparatus having a liquid ejecting head module. The liquid ejecting head module includes a liquid ejecting head detachably attached to a fixing member and the liquid ejecting head can ejects a liquid as liquid droplets from a liquid storage unit such as a cartridge or a tank in which the liquid is stored.

The liquid ejecting head includes a pressure generation chamber communicating with a nozzle opening provided at a nozzle plate, and a pressure generation unit which causes a pressure change in the ink inside the pressure generation chamber and ejects liquid droplets from the nozzle opening. Then, pressure generation units mounted on the liquid ejecting head include, for example, units using a vertically oscillating type piezoelectric element, a bending vibration type piezoelectric element, a heating element and an electrostatic force.

The ink ejected from the liquid ejecting head has viscosity suitable for the ejection according to a type of ink. Since the viscosity of the ink has a correlation with the temperature, the ink has a property in which the viscosity is high when the temperature is low and the viscosity is low when the temperature is high. Thus, it is necessary to correct a driving signal which drives the pressure generation unit of the liquid ejecting head according to the viscosity which is changed by the temperature of the ink (see, for example, JP-A-6-31934 and JP-A-2009-56669).

It is preferable that the temperature of the ink be measured in a state immediately before being ejected, that is, in the vicinity of the nozzle opening. However, it is difficult to measure the temperature of the ink in the vicinity of the nozzle opening by providing a temperature sensor at the nozzle plate, from a viewpoint of manufacturing, stiffness or the like of the nozzle plate.

Then, it is also considered to measure the temperature of the ink in the upstream side rather than in the vicinity of the nozzle opening. However, an error occurs the measured temperature and the temperature of the liquid inside the pressure generation chamber immediately before being ejected. When the driving signal is corrected, based on the inaccurate temperature of the ink, there is a problem in that the correction of the driving signal suitable for actual viscosity of the ink may not be carried out and thereby degraded ejection characteristic is may cause a printing quality to be deteriorated.

In addition, the problem is not limited to the ink jet type recording head module and also similarly exists in a liquid ejecting head module ejecting liquid other than the ink.

SUMMARY

An advantage of some aspects of the invention is to provide a liquid ejecting head module and a liquid ejecting apparatus which improve a liquid ejecting characteristic and can improve a printing quality.

According to an aspect of the invention, there is provided a liquid ejecting head module including: a liquid ejecting head having a nozzle plate on which a nozzle opening ejecting a liquid is provided; a fixing member to which the liquid ejecting head is fixed; and a temperature measurement unit attached to the fixing member, wherein the temperature measurement unit is biased to the nozzle plate side so as to come into contact with the nozzle plate and measures a temperature of the nozzle plate.

In the aspect, the temperature of the nozzle plate, which is in direct contact with the liquid in the vicinity of the nozzle plate, is measured. Thus, the temperature of the liquid immediately before the ejection can be accurately measured more than measuring the temperature of the liquid in a portion that is not in the vicinity of the nozzle opening. As described above, since the liquid ejecting head module according to the embodiment can measure the temperature of the liquid immediately before the ejection, a driving signal that is suitable for the practical viscosity of the liquid can be obtained by correcting the driving signal, based on the temperature. According to the aspect, the liquid ejecting head module is configured such that a liquid ejecting characteristic is improved and a printing quality is improved.

In addition, since the temperature measurement unit is provided on the fixing member, there is no need to provide the temperature measurement unit on the liquid ejecting head side. According to the aspect, the cost of the liquid ejecting head can be reduced or the number of manufacturing steps thereof can be omitted. Further, there is no need to replace the liquid ejecting head, just by replacing the temperature measurement unit provided on the fixing member, even though the temperature measurement unit fails. Accordingly, the cost incurred when the temperature measurement unit fails can be reduced.

It is preferable that the temperature measurement unit include a ground member which electrically connects the liquid ejecting head and the fixing member, and a temperature sensor provided at the ground member. The ground member may be biased to the nozzle plate side and may come into contact with the nozzle plate, and the temperature sensor may measure the temperature of the nozzle plate via the ground member. According to the aspect, the number of the members can be decreased and the cost can be reduced compared to a configuration in which the member for grounding the liquid ejecting head and the member for measuring the temperature of the nozzle plate are separately provided.

In addition, it is preferable that the liquid ejecting head have a protection member which comes into contact with the nozzle plate and protects the nozzle plate, and the temperature measurement unit be in contact with the protection member and measures the temperature of the nozzle plate via the protection member. According to the aspect, the temperature of the nozzle plate may be measured while protecting the nozzle plate.

In addition, it is preferable that a liquid ejecting head unit including a plurality of the liquid ejecting heads be fixed to the fixing member. According to the aspect, long nozzle row or high accuracy of the nozzle opening may be achieved, and the temperature of the nozzle plate of each liquid ejecting head can be accurately measured.

Furthermore, according to another aspect of the invention, there is provided a liquid ejecting apparatus including the liquid ejecting head module described above.

According to the aspect, the liquid ejecting apparatus is provided such that the liquid ejecting characteristic is improved and thereby the printing quality can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

The invention will be described in detail, based on the embodiments. Hereinafter, an ink jet type recording head module (hereinafter, simply, referred to as a head module) is an example of a liquid ejecting head module. An ink jet type recording head (hereinafter, simply, referred to as a head) is an example of a liquid ejecting head. In the embodiment, the head module is configured in such a manner that a head unit including a plurality of heads is provided at a carriage 210 (a fixing member) described below.

Figure 1:
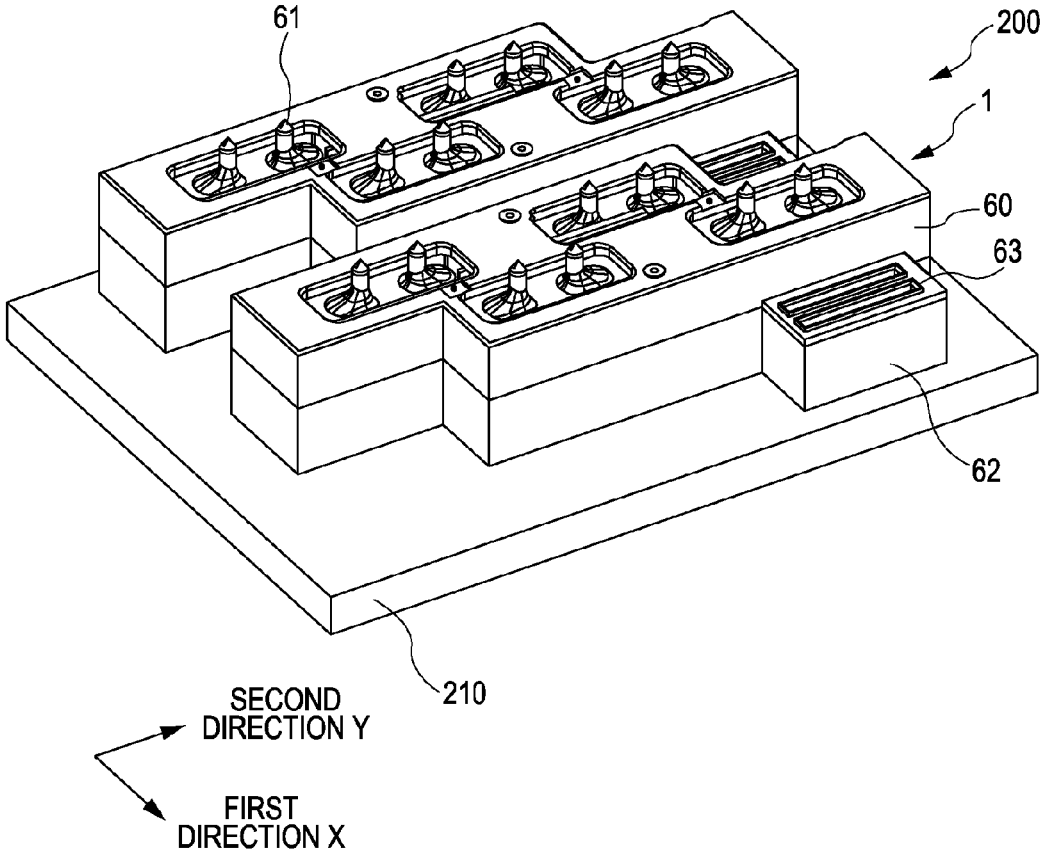
FIG. 1 is a perspective view of a head module according to a first embodiment.
Figure 2:
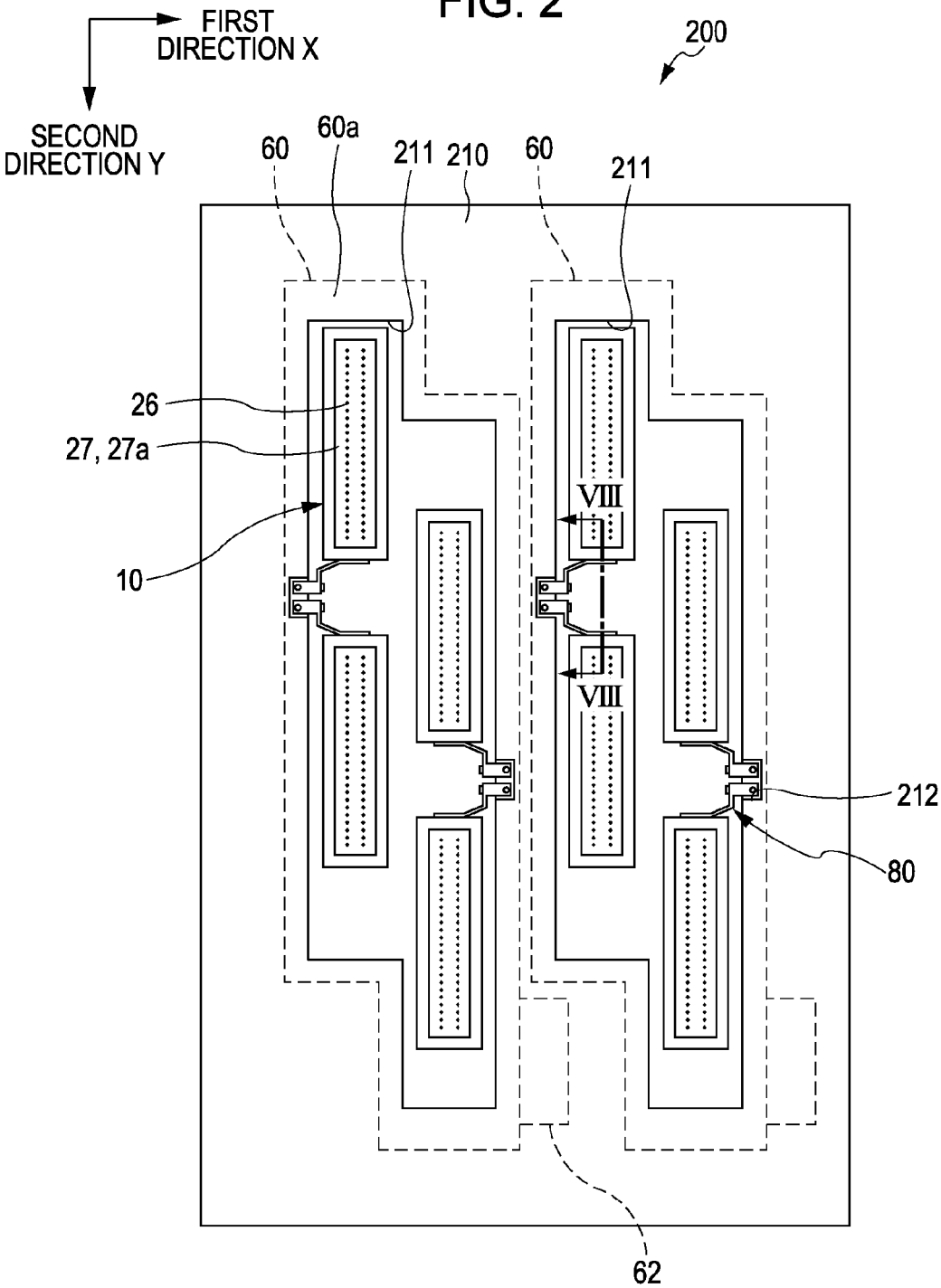
FIG. 2 is a plan view of the head module according to the first embodiment.
Figure 3:
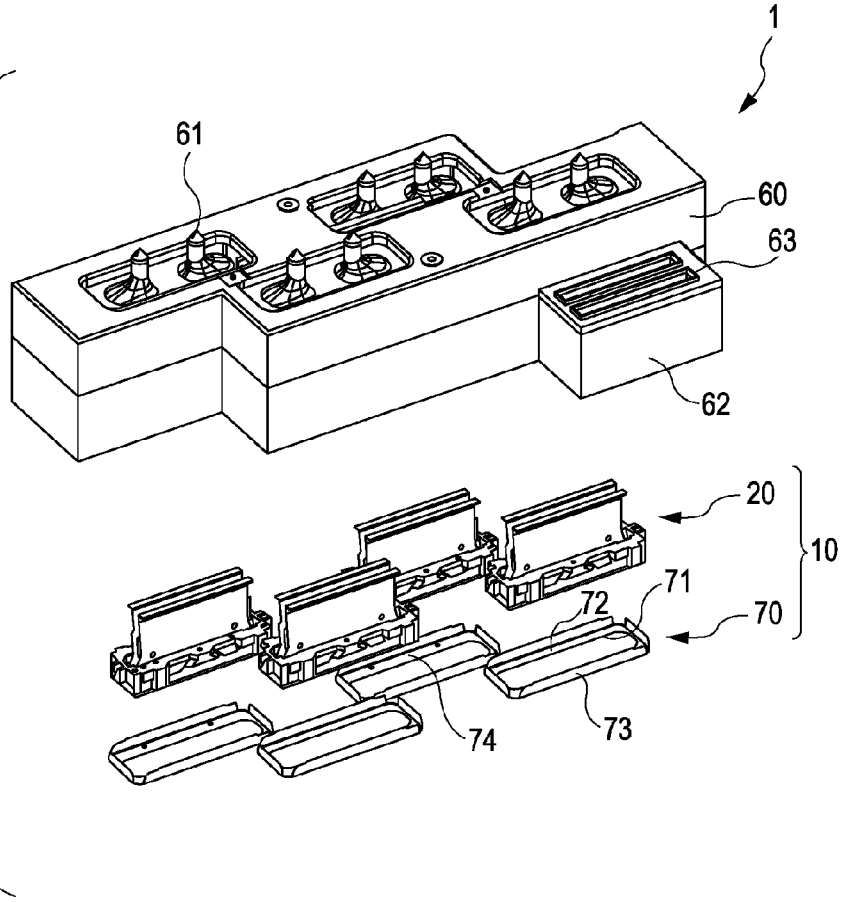
FIG. 3 is an exploded perspective view of a head unit according to the first embodiment.

FIG. 1 is a perspective view of the head module according to the embodiment, FIG. 2 is a plan view of the head module according to the embodiment and FIG. 3 is an exploded perspective view illustrating the head unit according to the embodiment.

As illustrated in FIGS. 1 and 2, a head module 200 includes a head unit 1 fixed to the carriage 210 that is an example of the fixing member. In the embodiment, two head units 1 are fixed to the carriage 210.

The carriage 210 is a member which is formed of a material, such as metal having conductivity in a plate-like shape. Two opening sections 211 are provided on the carriage 210 corresponding to each head unit 1. The carriage 210 described above is attached to the ink jet type recording apparatus described below and relatively moves with respect to a recording sheet such as a paper to be printed. As illustrated in FIG. 2, a direction of the relative movement with respect to the recording sheet, is referred to as a first direction X and a direction orthogonal to the first direction X is referred to as a second direction Y.

The head unit 1 is detachably fixed to the carriage 210 so that a nozzle opening 26 side of a head 10 appears at the opening section 211 of the carriage 210 described above.

As illustrated in FIG. 3, the head unit 1 includes a plurality of (four in the embodiment) the heads 10 and a holding member 60.

The holding member 60 is, for example, formed of a resin material and includes a flow path member where a circuit substrate or an ink communication path is formed, and a filter which removes dust or air bubbles or the like. Ink supply needles 61 (for example, eight in the embodiment) are fixed to an upper surface (a surface of the opposite side of the head 10) of the holding member 60. A storage unit (not illustrated) in which each color ink is stored is connected to the ink supply needles 61, directly or via a tube. An end of the ink communication path (not illustrated) is communicated with the ink supply needles 61. The other end of the ink communication path is open to a head body 20 side (the bottom side of the holding member 60). In other words, the ink is supplied from an ink cartridge to the ink communication path via the ink supply needles 61. The supplied ink is supplied to each of the head bodies 20, respectively.

The holding member 60 has an extension section 62 protruding to the first direction X side at one of the side surfaces which is parallel to the second direction Y. A connector (not specifically illustrated) of a circuit substrate, which is provided inside thereof, is disposed at the extension section 62 and an outer wiring inserted through a slit 63 provided on the upper surface of the extension section 62 and is connected to the connector of the wiring substrate. In addition, a drive wiring 35 (see, FIG. 4) of a plurality of the heads 10 are jointly connected to the circuit substrate.

Further, as illustrated in FIG. 2, the plurality of heads 10, which are positioned in predetermined intervals, are fixed to the holding member 60 so that the nozzle opening 26 appears on a bottom surface 60*a* side.

Figure 4:
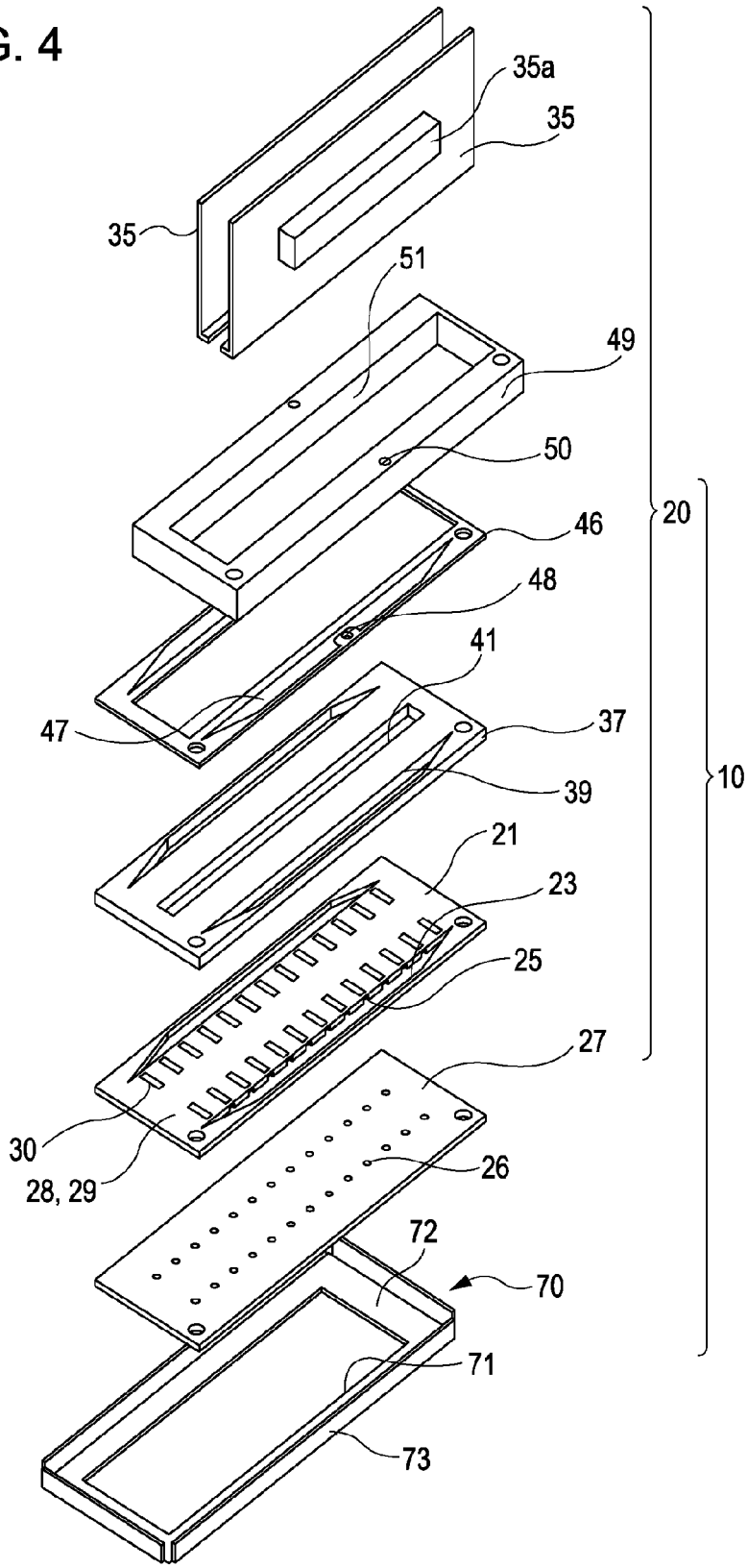
FIG. 4 is an exploded perspective view of a head according to the first embodiment.
Figure 5:
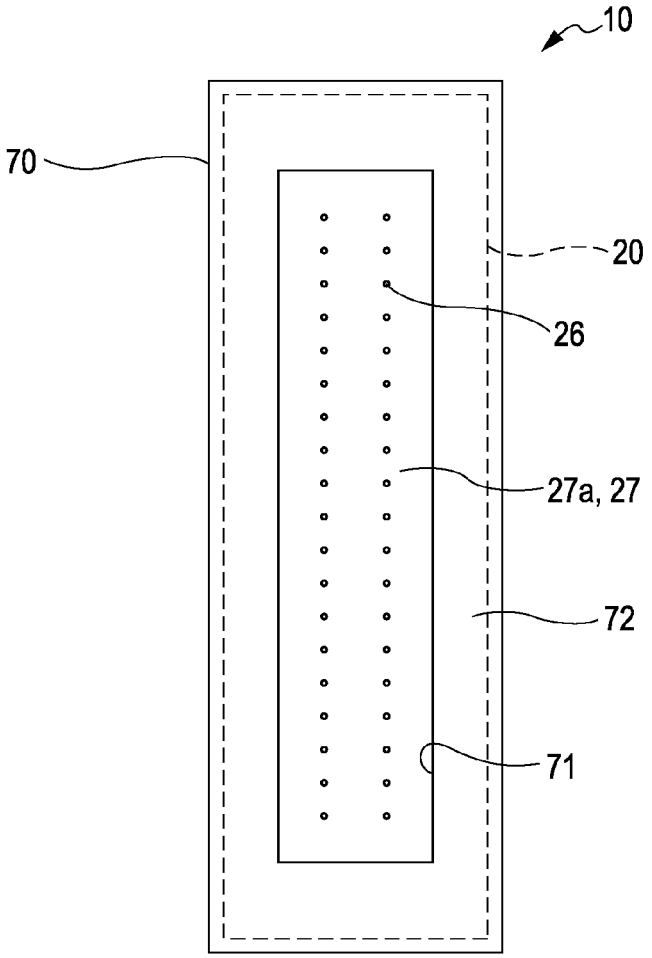
FIG. 5 is a plan view of the head according to the first embodiment.
Figure 6:
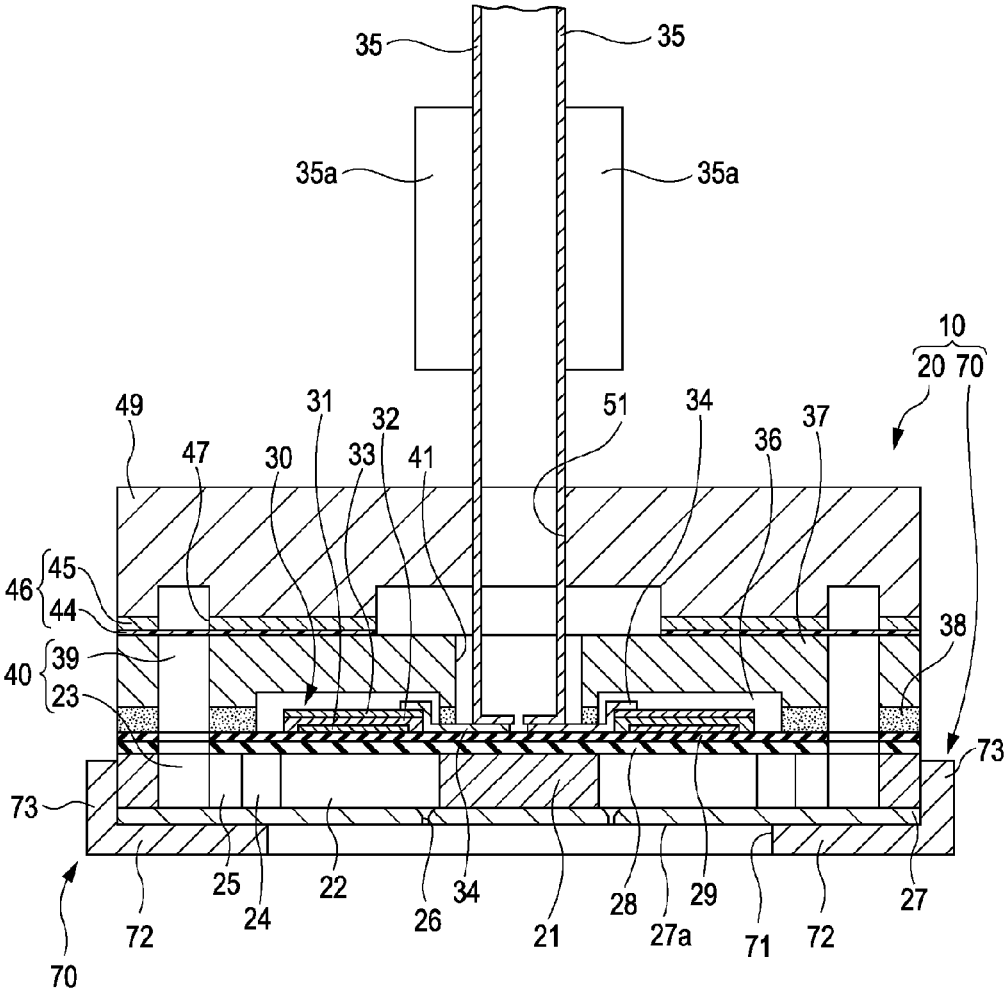
FIG. 6 is a cross-sectional view of the head according to the first embodiment.

An example of the configuration of the head 10 will be described with reference to FIGS. 4 to 6. FIG. 4 is an exploded perspective view of the head according to the embodiment, FIG. 5 is a plan view illustrated from a liquid ejecting surface side of the head, and FIG. 6 is a cross-sectional view in the longitudinal direction of the pressure generation chamber of the head. Here, the longitudinal direction of the pressure generation chamber is a direction (the first direction X in FIG. 2) orthogonal to a direction (the second direction Y in FIG. 2) in which the nozzle openings 26 are arranged in parallel.

As illustrated in the drawings, a plurality of pressure generation chambers 22 are provided in two rows which are arranged in parallel in the width direction thereof, at a flow path formation substrate 21 configuring the head 10. In addition, a communication section 23 is formed at an outside region of the outside in the longitudinal direction of the pressure generation chambers 22 in each row. The communication section 23 and each pressure generation chamber 22 communicate with each other via an ink supply path 24 and a communication path 25 which are provided at each pressure generation chamber 22.

A nozzle plate 27, in which the nozzle opening 26 communicating with the vicinity of the end portion of the opposite side to the ink supply path 24 of each pressure generation chamber 22 is drilled, is joined to one side surface of the flow path formation substrate 21.

Meanwhile, a piezoelectric actuator 30 is formed on a surface of the opposite side to the nozzle plate 27 of the flow path formation substrate 21 via an elastic film 28 and an insulating film 29. The piezoelectric actuator 30 is configured of a first electrode 31, a piezoelectric layer 32 and a second electrode 33. A lead electrode 34 extending onto the insulating film 29 is connected to the second electrode 33 configuring each piezoelectric actuator 30. One end of the lead electrode 34 is connected to the second electrode 33 and the other end thereof is connected to a drive wiring 35 on which a driving IC 35*a* that is a flexible wiring member (a COF substrate) and drives the piezoelectric actuator 30 is mounted.

On the flow path formation substrate 21 on which the piezoelectric actuator 30 described above is formed, a protection substrate 37, which includes a piezoelectric actuator holding section 36 that is a space for protecting the piezoelectric actuator 30, is joined to a region facing the piezoelectric actuator 30, using adhesive 38. In addition, the protection substrate 37 has a manifold section 39. In the embodiment, the manifold section 39 is communicated with the communication section 23 of the flow path formation substrate 21 and then configures a manifold 40 which is a common ink chamber of each pressure generation chamber 22.

In addition, the protection substrate 37 has a through hole 41 passing through the protection substrate 37 in the thickness direction. In the embodiment, the through hole 41 is provided between two piezoelectric actuator holding sections 36. Then, the vicinity of the end portion of the lead electrode 34 drawn out from each piezoelectric actuator 30 is provided so as to be exposed inside the through hole 41.

Furthermore, a compliance substrate 46 configured of a sealing film 44 and a fixing plate 45 is joined on the protection substrate 37. Here, the sealing film 44 is formed of a material having flexibility and a low stiffness, and seals one side surface of the manifold section 39. In addition, the fixing plate 45 is formed of a hard material such as metal. Since a region facing the manifold 40 of the fixing plate 45 is an opening section 47 which is completely removed in the thickness direction, one side surface of the manifold 40 is sealed with only the sealing film 44 having the flexibility. The compliance is given inside the manifold 40 at the region sealed with only the sealing film 44. Furthermore, the compliance substrate 46 has an ink inlet port 48 for introducing the ink into the manifold 40.

A head case 49 that is a case member is fixed onto the compliance substrate 46. The head case 49 has an ink introduction path 50 which supplies the ink from a storage unit such as a cartridge to the manifold 40 by communicating with the ink inlet port 48. Furthermore, the head case 49 has a wiring member holding hole 51 communicating with the through hole 41 which is provided at the protection substrate 37. One end side of the drive wiring 35 is connected to the lead electrode 34 in a state of passing through the wiring member holding hole 51.

The head body 20 described above takes the ink into the ink inlet port 48 from the storage unit (not illustrated) via the ink communication path of the holding member 60. The ink fills the interior thereof from the manifold 40 to the nozzle opening 26. After that, a voltage is applied to each piezoelectric actuator 30 corresponding to the pressure generation chamber 22, according to a recording signal from the driving IC 35*a*. The elastic film 28, the insulating film 29 and the piezoelectric actuator 30 are deformed to be bent so that the pressure inside each pressure generation chamber 22 is increased and the ink droplets are ejected from the nozzle opening 26.

A cover head 70 that is a protection member is fixed to a liquid ejecting surface 27*a* side to which the nozzle opening 26 is open of the nozzle plate 27 of the head body 20.

The cover head 70 has a box shape in which edge portions of a plate-like member having a rectangular shape are bent to the side surface of the head body 20 to stand up and the bottom thereof is joined to the surface of the nozzle plate 27, that is, to the liquid ejecting surface 27*a*, using adhesive (not illustrated). In particular, the cover head 70 includes an exposure opening section 71 open in rectangular shape, through which the nozzle opening 26 is exposed, and a rectangular-shaped frame section 72 defining the exposure opening section 71. In addition, the cover head 70 has a side wall section 73 extending so as to be bent at the side surface orthogonal to the liquid ejecting surface 27*a* of the head body 20. The side wall section 73 covers four side surfaces of the head body 20.

The cover head 70 configured as described above is formed of a conductive material such as metal. Accordingly, the heat from the nozzle plate 27 is conducted to the side wall section 73 via the frame section 72 joined to the nozzle plate 27 via the adhesive. In other words, the temperature of the nozzle plate 27 can be measured via the side wall section 73, as will be described in detail below.

In addition, the cover head 70 is electrically grounded via a ground member described below. Thus, an electric charge charged to the head 10 moves from the nozzle plate 27 to the cover head 70 and is discharged outward from the head 10.

Figure 7:
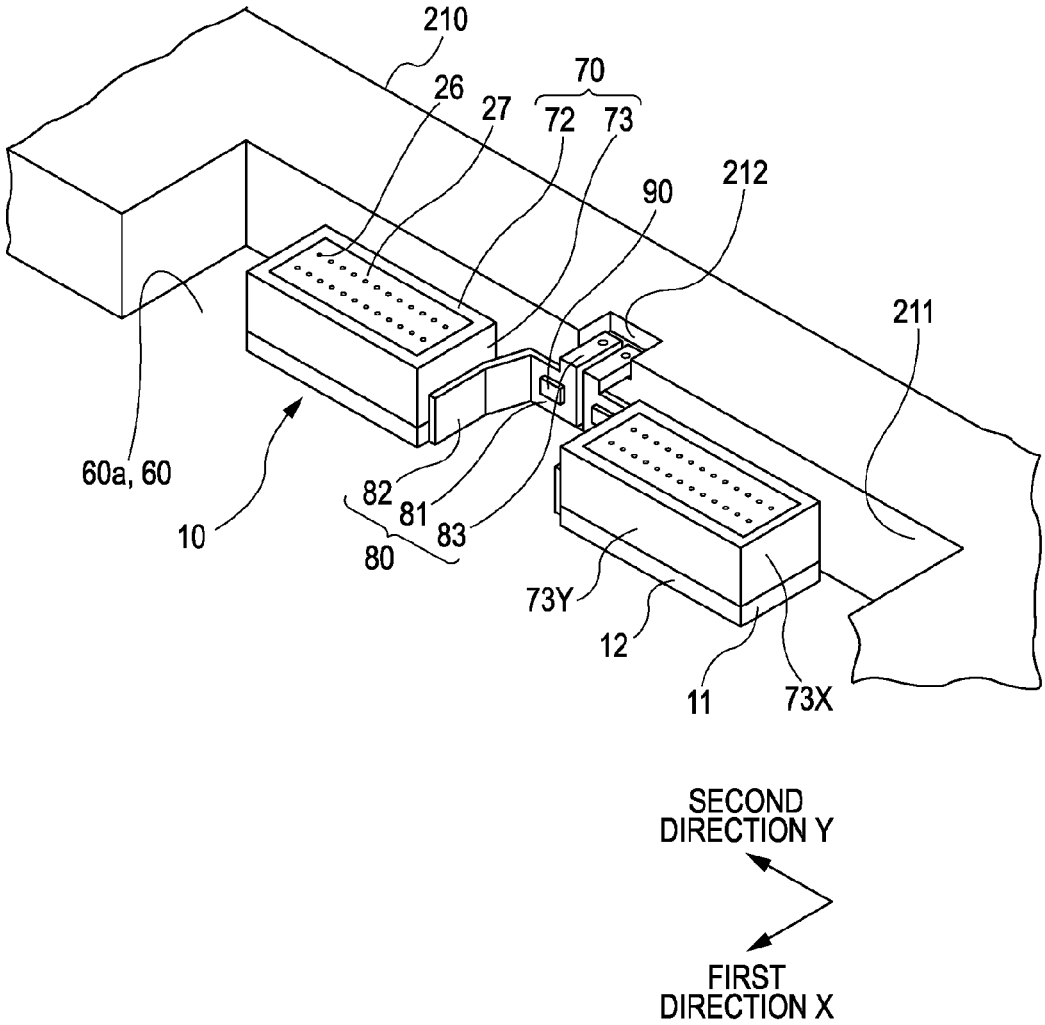
FIG. 7 is a perspective view of a main portion of the head module according to the first embodiment.

Here, a structure measuring the ink temperature of each head of the head module according to the embodiment will be described. FIG. 7 is a perspective view of a main portion of the head module according to the embodiment and FIG. 8 is an enlarged cross-sectional view illustrating a main portion taken along line VIII-VIII in FIG. 2.

Figure 8:
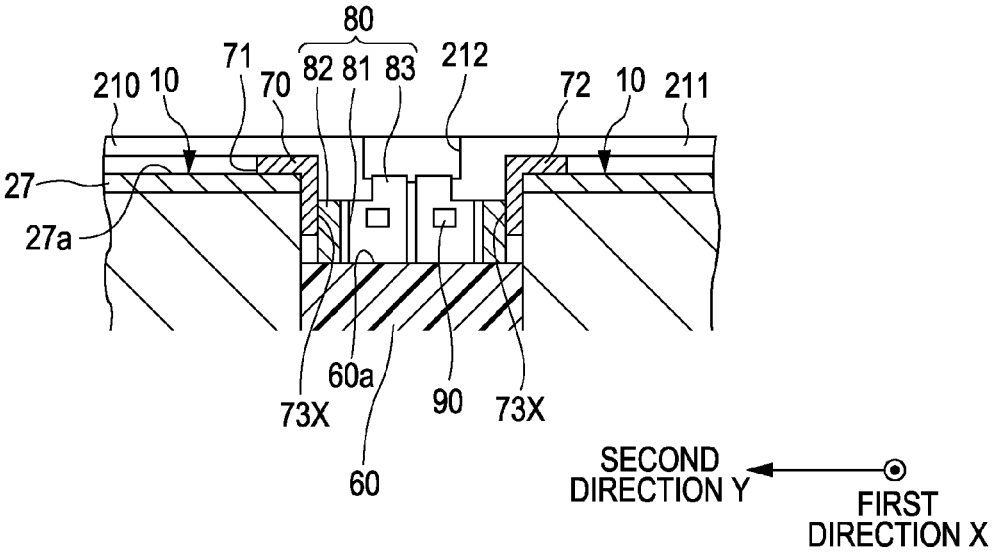
FIG. 8 is a cross-sectional view of a main portion of the head module according to the first embodiment.

As illustrated in FIGS. 7, 8 and 2, the holding member 60 has the plurality of the heads 10 so that the nozzle opening 26 appears on the bottom surface 60*a*. A portion which is protruded from the bottom surface 60*a* of the head 10 is substantially covered by the cover head 70. In other words, the frame section 72 covers the periphery of the surface of the nozzle plate 27 and the side wall section 73 covers the side surface of the head 10.

The side surface of the head 10 parallel to the first direction X is referred to as a first side surface 11 and the side surface of the head 10 parallel to the second direction Y is referred to as a second side surface 12. In addition, that covering the first side surface 11 of the side wall sections 73 of the cover head 70 is referred to as a side wall section 73X and that covering the second side surface 12 is referred to as a side wall section 73Y.

A temperature measurement unit according to the embodiment includes a ground member 80 and a thermistor 90 that is an example of a temperature sensor provided on the ground member 80.

The ground member 80 is a member that has a high thermal conductivity and is formed of a conductive material such as metal. In particular, the ground member 80 includes a plate-like body section 81, a contact section 82 which is extended from the body section 81 and is bent to one side surface, and a connection section 83 which is extended from the body section 81. The contact section 82 functions as a leaf spring whose bent portion is a base section and biases the first side surface 11 side of the head 10.

In the head module 200 according to the embodiment, one ground member 80 is provided for each one head 10, and two ground members 80, which correspond to each head 10 are disposed between two heads 10 arranged in parallel in the second direction Y.

The front end side of the contact section 82 of each ground member 80 is slightly pressed to the side wall section 73X of the cover head 70. Thus, a restoring force of the contact section 82 acts on the side wall section 73X side and the contact section 82 is further reliably in contact with the side wall section 73X.

In addition, the connection section 83 of the ground member 80 protrudes in the ejecting direction (a direction orthogonal to the first direction X and the second direction Y) of the ink from the body section 81 and is bent to the opposite side to the contact section 82. A groove section 212 which is continuous to the opening section 211 is formed on the surface of the carriage 210 and the connection section 83 is in contact with the bottom surface of the groove section 212. Since the depth of the groove section 212 from the surface of the carriage 210 is equal to or greater than the thickness of the connection section 83, the connection section 83 which is in contact with the bottom surface of the groove section 212 is prevented from protruding from the surface of the carriage 210. In addition, even though not specifically illustrated, the connection section 83 is fixed to the carriage 210 using a member such as a screw.

The thermistor 90 is provided at the body section 81 in order to be capable of measuring the temperature of the ground member 80. Even though not specifically illustrated, the thermistor 90 is connected to a controller which is configured of a CPU, a memory or the like provided at the ink jet type recording apparatus. The thermistor 90 can transmit a signal indicating the temperature to the controller, based on the heat transmitted to the thermistor 90.

As described above, the heat from the ink in the vicinity of the nozzle opening 26 is transmitted to the nozzle plate 27 and to the cover head 70. Then, the heat from the cover head 70 is also transmitted to the ground member 80 and is measured by the thermistor 90 provided at the ground member 80. In other words, the temperature of the ink in the vicinity of the nozzle opening is measured by the thermistor 90.

To describe in detail, the head unit 1 and the carriage 210 is detachably fixed, and the thermistor 90 measuring the temperature of the head 10 is provided at the carriage 210 side separately from the head 10. In the head module 200 having the configuration described above, when the head unit 1 is fixed to the carriage 210 and is integrated as the head module 200, the thermistor 90 can measure the temperature thereof, based on the heat from the nozzle plate 27.

As described above, in the head module 200 according to the embodiment, the temperature of the nozzle plate 27 that is in direct contact with the ink inside the pressure generation chamber 22 which is in the vicinity of the nozzle opening 26 is measured via the cover head 70 and the ground member 80. Thus, it is possible to accurately measure more the temperature of the ink immediately before ejection than measuring the temperature of the ink at a portion that is not in the vicinity of the nozzle opening 26, that is, at the upstream (for example, the ink communication path of the holding member 60 or the ink introduction path 50 of the head 10) of the liquid flow path or the like.

As described above, since the head module 200 according to the embodiment can accurately measure the temperature of the ink immediately before ejection, the driving signal is corrected, based on the temperature. Thus, the driving signal which is suitable for the actual viscosity of the ink can be obtained. Accordingly, in the head module 200 according to the embodiment, the ejection characteristic is improved and the printing quality is improved.

In addition, since the thermistor 90 is provided on the carriage 210, there is no need to provide the thermistor 90 on the head 10 side. Accordingly, the cost of the head 10 can be reduced or the number of manufacturing steps thereof can be omitted. Further, the ground member 80 is configured such that the ground member 80 is biased to the cover head 70 side of the head 10 to come into contact with the cover head 70. Accordingly, when the head 10 is attached to the carriage 210, the ground member 80 and the cover head 70 easily come into contact with each other and the temperature of the nozzle plate 27 can be reliably measured using the thermistor 90 via the cover head 70 and the ground member 80.

Further, since the thermistor 90 is provided on the carriage 210, the thermistor 90 provided on the carriage 210 is simply replaced and there is no need to replace the head 10, even though the thermistor 90 fails. Accordingly, the cost incurred when the thermistor 90 fails can be reduced compared to the configuration in which the thermistor 90 is provided on the head 10 as described below.

For example, when the thermistor 90 is provided on the head 10, it is structurally difficult to replace only the thermistor 90 and the head 10 itself is required to be replaced. Specifically, since the cost of the head 10 is higher than that of the carriage 210, in the configuration when the thermistor 90 is provided on the head 10, the cost, which is incurred when the thermistor 90 fails, is increased.

In addition, in the head module 200 according to the embodiment, since the thermistor 90 is provided on the carriage 210, even though the head 10 (the head unit 1) has failed, it is necessary to replace the head 10 (the head unit 1) only and the thermistor 90 is not required to be replaced.

The ground member 80 configuring the temperature measurement unit described above is used to measure the temperature of the nozzle plate 27 using the thermistor 90 and is also used to ground the head 10.

The ground member 80, the cover head 70 and the carriage 210 are formed of a conductive material such as metal. Thus, the head 10 is electrically connected to the carriage 210 via the nozzle plate 27, the cover head 70 (the side wall section 73X) and the ground member 80. Accordingly, the electric charge charged to the head 10 is discharged to the carriage 210. Then, even though not specifically illustrated, the carriage 210 is electrically connected to the ink jet type recording apparatus body and the head 10 is grounded to the ink jet type recording apparatus body via the carriage 210.

Since the charge of the head 10 is prevented as described above, the head 10, the piezoelectric actuator 30, the driving IC 35*a* or the like can be reliably prevented from being destructed, by a static electricity accumulated in the nozzle plate 27 for example.

Further, in the head module 200 according to the embodiment, the ground member 80 grounding the head 10 also serves as the member for measuring the temperature of the nozzle plate 27 with the thermistor 90. Accordingly, the number of the members can be decreased and the cost can be reduced compared to the configuration in which the member for grounding the head 10 and the member for measuring the temperature of the nozzle plate 27 are separately provided.

Second Embodiment

Figure 9:
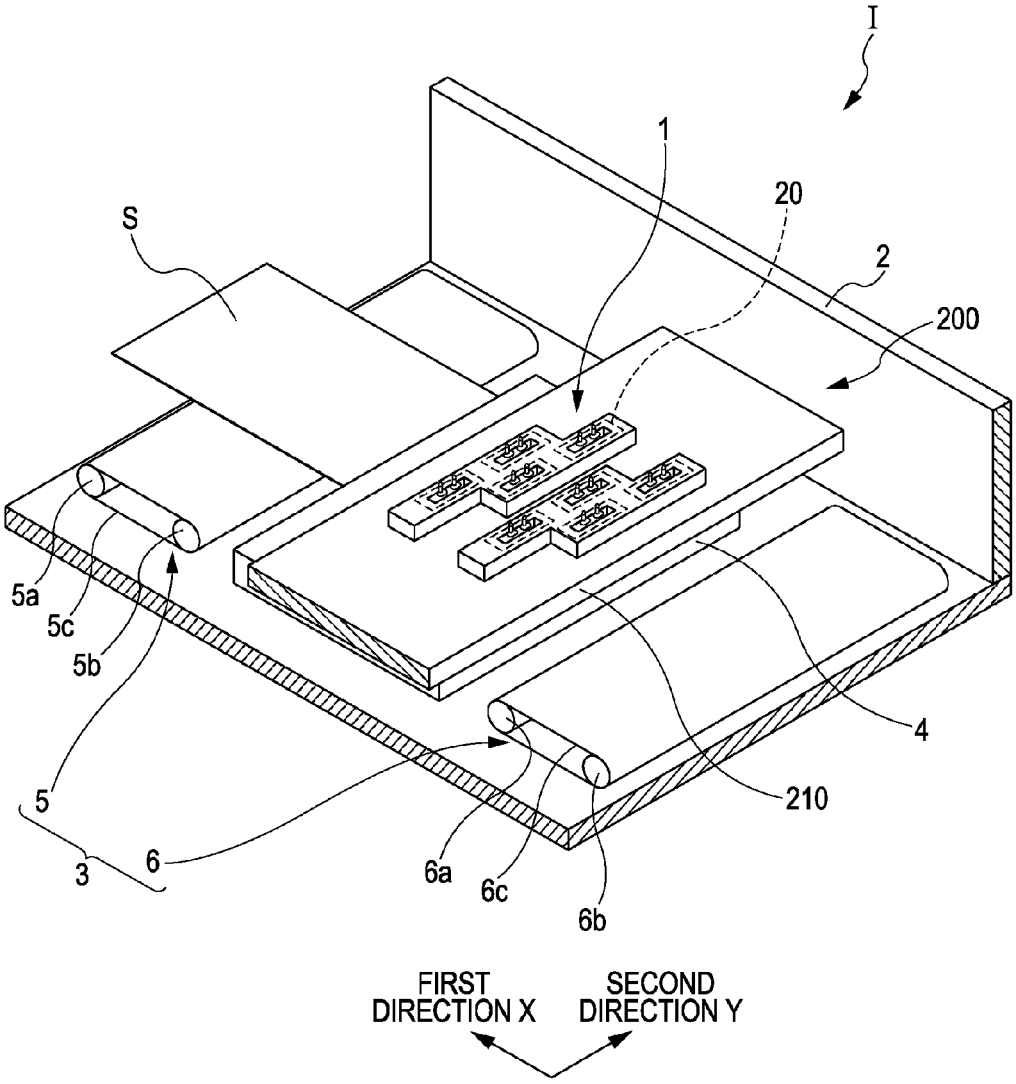
FIG. 9 is a perspective view of a recording apparatus according to the first embodiment.

The head module 200 described in the first embodiment is mounted on the ink jet type recording apparatus that is an example of the liquid ejecting apparatus. FIG. 9 is a schematic perspective view illustrating the ink jet type recording apparatus that is an example of the liquid ejecting apparatus according to a second embodiment of the invention. In addition, the same reference numeral will be denoted to the same configuration in the first embodiment and repeated description thereof will be omitted.

As illustrated in the drawing, an ink jet type recording apparatus I of the embodiment is so-called a line type recording apparatus in which the head module 200 is fixed and a recording sheet S such as a paper that is an ejected medium is transported to performs the printing. The first direction X is a direction in which the carriage 210 relatively moves with respect to the recording sheet S of the carriage 210 and the second direction Y is a direction orthogonal to the first direction X.

In particular, the ink jet type recording apparatus I includes an apparatus body 2, the head module 200 fixed to the apparatus body 2, a transportation unit 3 transporting the recording sheet S that is an object medium for ejection and a platen 4 supporting a back side opposite to the printing surface of the recording sheet S facing the head module 200.

The head module 200 is fixed to the apparatus body 2 such that the arrangement direction of the nozzle opening 26 of the head 10 is the second direction Y orthogonal to the transportation direction (the first direction X) of the recording sheet S.

The transportation unit 3 includes a first transportation unit 5 and a second transportation unit 6 which are provided at both sides in the transportation direction of the recording sheet S with respect to the head module 200.

The first transportation unit 5 is configured of a driving roller 5*a*, a driven roller 5*b* and a transportation belt 5*c* wound around the driving roller 5*a* and the driven roller 5*b*. In addition, similar to the first transportation unit 5, the second transportation unit 6 is configured of a driving roller 6*a*, a driven roller 6*b* and a transportation belt 6*c*.

A driving unit such as a driving motor (not illustrated) is connected to the driving rollers 5*a* and 6*a* of the first transportation unit 5 and the second transportation unit 6 respectively. The transportation belts 5*c* and 6*c* are rotated using the driving force of the driving unit so that the recording sheet S is transported to the upstream and downstream sides of the head module 200.

In addition, in the embodiment, the first transportation unit 5 and the second transportation unit 6 configured of the driving rollers 5*a* and 6*a*, the driven rollers 5*b* and 6*b*, and the transportation belts 5*c* and 6*c* are exemplified. However, a holding unit which holds the recording sheet S on the transportation belts 5*c* and 6*c* may be provided. For example, the holding unit may be configured in such a manner that a charging unit which charges the outer periphery surface of the recording sheet S is provided and the recording sheet S charged by the charging unit may be adsorbed onto the transportation belts 5*c* and 6*c* by the action of the induced polarization. In addition, as the holding unit, a pressing roller may be provided on the transportation belts 5*c* and 6*c*, the recording sheet S may be interposed between the pressing roller and the transportation belts 5*c* and 6*c*.

The platen 4 is provided between the first transportation unit 5 and the second transportation unit 6 to face the head module 200 and is formed of metal, resin or the like having a rectangular shape in the cross-section thereof. The platen 4 supports the recording sheet S transported using the first transportation unit 5 and the second transportation unit 6 at a position facing the head module 200.

In addition, an adsorption unit adsorbing the transported recording sheet S on the platen 4 may be provided at the platen 4. The adsorption unit may include, for example, a unit which sucks and adsorbs the recording sheet S by sucking the recording sheet S or a unit which electrostatically adsorbs the recording sheet S using the electrostatic force.

In addition, even though not illustrated, an ink storage unit such as an ink tank, an ink cartridge or the like in which the ink is stored may be connected to the head module 200 so as to supply the ink. The ink storage unit, for example, may be held on the head module 200 or may be held in a position different from the head module 200 inside the apparatus body 2 and is connected to the ink supply needles 61 of each head unit 1 via a tube or the like. Further, an outer wiring (not illustrated) is connected to each head unit 1 of the head module 200.

In the ink jet type recording apparatus I, the recording sheet S is transported using the transportation unit 5 and the printing is carried out on the recording sheet S supported on the platen 4 using the head module 200. The printed recording sheet S is transported using the transportation unit 3.

Then, the driving rollers 5*a* and 6*a*, the pressure generation unit of the head module 200, or the like is controlled by a controller configured of CPU (not illustrated), memory or the like so as to be operated. The controller is configured such that a signal indicating the temperature of the nozzle plate 27 is measured by the thermistor 90 described in the first embodiment, that is, the signal indicating the temperature of the ink inside the pressure generation chamber is received. Thus, the controller corrects the driving signal applying to the piezoelectric actuator 30 that is the pressure generation unit of the head 10 to the driving signal suitable for the temperature of the ink inside the pressure generation chamber, based on the temperature. Accordingly, the piezoelectric actuator 30 can be driven with the driving signal (a driving waveform) suitable for the practical temperature of the ink inside the pressure generation chamber, the ejection characteristics of the ink are improved and the printing quality can be improved.

In addition, in the embodiment, so-called a line type ink jet type recording apparatus I is exemplified in which the head unit 1 (the head module 200) is fixed to the apparatus body 2 and the printing is carried out only by transporting the recording sheet S. However, the invention is not specifically limited to the embodiment, and for example, the invention may be applied to so-called a serial type recording apparatus in which the head unit 1 (the head module 200) is mounted on a carriage which moves the head unit 1 in the main scanning direction orthogonal to the transportation direction of the recording sheet S and the printing is carried out while the head unit 1 (the head module 200) is moved in the main scanning direction.

Other Embodiments

Hereinabove, each embodiment of the invention has been described, however, the basic configuration of the invention is not limited to the description above.

The invention is not limited to the head module 200 to which two head units 1 are fixed. The invention may be applied to the head module in which one or a plurality of the head units 1 are provided. In addition, four heads 10 are provided at the head unit 1, however, the invention is not limited to the embodiment. It may be the head unit in which one or a plurality of the head 10 are provided.

In addition, the head module 200 is configured such that the head unit 1 including the plurality of heads 10 is detachably fixed to the carriage 210, however, the invention is not limited to the aspect. For example, it may be the head module in which the head 10 is detachably fixed to the carriage 210 without configuring the head unit 1.

Furthermore, the head module 200 employs the thermistor 90 measuring the temperature of the nozzle plate 27 via the ground member 80, however, the invention is not limited to the embodiment. For example, the thermistor 90 may be configured so as to be directly biased to come into contact with the cover head 70. In this case, since the ground member 80 is not intervened, accordingly, the temperature of the nozzle plate 27 can be more accurately measured.

As a temperature measurement unit, the configuration including the ground member 80 and the thermistor 90 is described, however, the invention is not limited to the aspect. A configuration may be employed in which the thermistor 90 is attached to a member different from the ground member 80 and the member is biased to come into contact with the cover head 70.

Furthermore, the configuration is exemplified in which the temperature of the nozzle plate 27 is measured via the cover head 70 covering the nozzle plate 27, however, the invention is not limited to the aspect. In other words, the temperature measurement unit may be configured so as to be in contact with the nozzle plate 27 directly without intervening the cover head 70. For example, a configuration may be employed in which the thermistor 90 or a member, which has high thermal conductivity to which the thermistor 90 is attached, is biased to come into contact with the surface side of the nozzle plate 27. In this case, the temperature of the nozzle plate 27 can be more accurately obtained while eliminating the need for the process of providing the thermistor 90 to the head 10.

Furthermore, the thermistor 90 is used as the temperature sensor, however, the invention is not limited to the embodiment, and the well-known sensor may be used in which the temperature can be measured to output the signal indicating the temperature.

As the fixing member, the carriage 210 attached to the ink jet type recording apparatus I is exemplified, however, the invention is not limited to the embodiment. The head module may be configured by fixing the head unit 1 to a member different from the carriage, the head module may be attached to the carriage and may be provided at the ink jet type recording apparatus I. In addition, the member configuring the ink jet type recording apparatus I may be the fixing member.

In each embodiment described above, the description is given in which the thin film type piezoelectric actuator 30 is used as the pressure generation unit which generates the pressure change in the pressure generation chamber 22, the invention is not specifically limited to the embodiment. For example, a thick film type piezoelectric actuator formed using a method may be used, in which a green sheet is attached or a vertically oscillating type piezoelectric actuator may be used in which the piezoelectric material and the electrode formation material are alternately laminated. In addition, as the pressure generation unit, a unit may be used in which a heating element is disposed inside the pressure generation chambers and the liquid droplets are ejected from the nozzle opening using the bubbles generated by heating from a heating element, or so-called an electrostatic actuator may be used, in which the liquid droplets are ejected from the nozzle opening by deforming the vibration plate using an electrostatic force.

In the embodiments described above, the ink jet type recording head is described as an example of the liquid ejecting head. However, the invention is widely intended for general liquid ejecting heads and, of course, can be applied to a liquid ejecting head ejecting the liquid in addition to the ink. The liquid ejecting head in addition thereto, for example, includes various recording heads used for an image recording apparatus such as a printer, a color material ejecting head used for producing the color filter of a liquid crystal display, an electrode material ejecting head used for forming electrodes of an organic EL display, FED (Field Emission Display) or the like, a bioorganic matter ejecting head used for production of a bio chip, or the like.

The entire disclosure of Japanese Patent Application No. 2012-012492, filed Jan. 24, 2012 is incorporated by reference herein.

What is claimed is:

1. A liquid ejecting head module comprising:

a liquid ejecting head having a nozzle plate on which a nozzle opening ejecting a liquid is provided;

a fixing member to which the liquid ejecting head is fixed; and a temperature measurement unit attached to the fixing member, wherein the temperature measurement unit is biased to a side of the nozzle plate so as to come into contact with the nozzle plate and measures a temperature of the nozzle plate, wherein the temperature measurement unit includes a ground member which electrically connects the liquid ejecting head and the fixing member, and a temperature sensor provided at the ground member, wherein the ground member is biased to the side of the nozzle plate and comes into contact with the nozzle plate, and wherein the temperature sensor measures the temperature of the nozzle plate via the ground member.

2. A liquid ejecting head module comprising:

a liquid ejecting head having a nozzle plate on which a nozzle opening ejecting a liquid is provided;

a fixing member to which the liquid ejecting head is fixed; and a temperature measurement unit attached to the fixing member, wherein the temperature measurement unit is biased to a side of the nozzle plate so as to come into contact with the nozzle plate and measures a temperature of the nozzle plate, wherein the liquid ejecting head has a protection member which comes into contact with the nozzle plate and protects the nozzle plate, and wherein the temperature measurement unit comes into contact with the protection member and measures the temperature of the nozzle plate via the protection member.

3. The liquid ejecting head module according to claim 1, wherein a liquid ejecting head unit including a plurality of the liquid ejecting heads is fixed to the fixing member.

4. A liquid ejecting apparatus comprising the liquid ejecting head module according to claim 1.

5. A liquid ejecting apparatus comprising the liquid ejecting head module according to claim 2.

6. A liquid ejecting apparatus comprising the liquid ejecting head module according to claim 3.

* * * * *